US006957460B2

(12) United States Patent
Horitani

(10) Patent No.: US 6,957,460 B2
(45) Date of Patent: Oct. 25, 2005

(54) MECHANICAL SYSTEM FOR OPERATING THE BACK AND KNEE BOTTOM SECTIONS OF A BED OR THE LIKE IN AN INTERLOCKED MANNER

(75) Inventor: Masao Horitani, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 130 days.

(21) Appl. No.: 10/463,533

(22) Filed: Jun. 18, 2003

(65) Prior Publication Data

US 2004/0064891 A1 Apr. 8, 2004

(30) Foreign Application Priority Data

Jun. 19, 2002 (JP) ..... 2002-178253

(51) Int. Cl.[7] ..... A61G 7/015; A61G 7/018
(52) U.S. Cl. ..... 5/618; 5/613
(58) Field of Search ..... 5/618, 613, 616, 5/617

(56) References Cited

U.S. PATENT DOCUMENTS 5,388,290 A * 2/1995 Shirai ..... 5/236.1
5,448,789 A * 9/1995 Shirai ..... 5/613
5,469,591 A * 11/1995 Nomura ..... 5/613
2003/0106154 A1 * 6/2003 Takeuchi ..... 5/618

* cited by examiner

*Primary Examiner*—Alexander Grosz
(74) *Attorney, Agent, or Firm*—Townsend & Banta

(57) ABSTRACT

A mechanical system for operating the back and knee bottom sections of a bed or the like in an interlocked manner, comprising a back lifting mechanism and a knee lifting mechanism connected with each other by an interlocking means, to ensure that they can be operated in such an interlocked manner that, halfway in the operation for inclining said back bottom section, said knee bottom section reaches the largest inclination angle, and that, before said back bottom section halfway in the action for inclination reaches the largest inclination, said knee bottom section returns to lie flat.

10 Claims, 4 Drawing Sheets

MECHANICAL SYSTEM FOR OPERATING THE BACK AND KNEE BOTTOM SECTIONS OF A BED OR THE LIKE IN AN INTERLOCKED MANNER

FIELD OF THE INVENTION

The present invention relates to a so-called gatch bed that allows its back and knee bottom sections to be lifted, more particularly, a mechanical system for operating the back and knee bottom sections of a bed or the like in an interlocked manner, in which the knee bottom section can be operated in interlocked relation with the back lifting action.

BACKGROUND OF THE INVENTION

Prior Art

Some of lying furniture such as beds and stretchers are respectively provided with a back bottom section for lifting the back portion of a lying person and a knee bottom section for lifting his/her knee portion, which can be respectively lifted by lifting mechanisms respectively provided for them.

Many examples of such lying furniture can be seen in U.S. Pat. Nos. 5,469,591, 5,448,789, 5,388,290, etc.

For example, the bed described in U.S. Pat. No. 5,469,591 has a back bottom section for lifting the back portion of a lying person, a knee bottom section for lifting his/her knee portion, and other bottom sections. On the undersides of the back bottom section and the knee bottom section, lifting arms each having a roller at the tip are installed pivotally rotatably, and the lifting arms can be driven and rotated by electric drive mechanisms such as motors.

In this constitution, the lifting arm of the back bottom section is pivotally rotated to let its roller lift the back bottom section in a pivotally rotating motion, for making it inclined, thereby lifting the back of the lying person, so that he/she can get up on the bed.

When the back bottom section is lifted and inclined like this, the lifting arm of the knee bottom section is pivotally rotated to let its roller lift the knee bottom section in a pivotally rotating motion, for making it inclined, thereby effectively preventing the lying person from sliding forward if the back bottom section only is lifted.

That is, in the case where the person lying on the bed is lifted at his/her back, to get up, if the back bottom section is lifted, his/her body gradually slides forward since he/she is pressed forward at his/her back by the back bottom section.

In recent years, some of so-called gatch beds that allow their back and knee bottom sections to be lifted have (1) a mechanical system for allowing knee lifting action in interlocked relation with back lifting action, or have (2) a mechanical system that can be engaged in and disengaged from the interlocked relation between back lifting action and knee lifting action.

Problems to be Solved by the Invention

However, in the above-mentioned mechanical system (1), the knees are merely lifted in relation with back lifting. So, if the back lifting angle becomes more than a certain angle, the user receives a strong pressure with the lower half of his/her body squeezed between the back and knee bottom sections, since the back and knee bottom sections become too close to each other. Furthermore, in a state where the back bottom section is lifted at an elevated position, the knee bottom section is also lifted at an elevated position without fail, and it is difficult for the user to move on the bed bottom to a lateral side of the bed; and sit on the bottom with his/her feet placed on the floor.

On the other hand, in the mechanical system (2), to reduce the pressure to the body of the user, and also to allow him/her to move on the bed bottom to a lateral side and to sit on the bottom with his/her feet placed on the floor when the gatch mechanism is actuated, the back and knee lifting mechanisms are disengaged from the interlocked relation. However, since the back bottom section only is lifted, the body of the user slips from the back bottom section or his/her posture is disfigured to cause another kind of pressure to the body.

In this background, the present invention is proposed. The object of the invention is to provide a mechanical system for operating the back and knee bottom sections of a bed or the like in an interlocked manner, in which knee lifting action is used in interlocked relation with back lifting action in the beginning; after halfway in the back lifting action, knee lowering action is used to reduce the pressure acting on the body of the user; and after the back bottom section has been lifted to an elevated position using the gatch mechanism, the position of the user can be easily changed to allow him/her to sit on a lateral side of the bed bottom with his/her legs placed on the floor, for allowing easier care.

SUMMARY OF THE INVENTION

To solve the above-mentioned problems, this invention proposes, a mechanical system for operating the back and knee bottom sections of a bed or the like in an interlocked manner, comprising a back lifting mechanism and a knee lifting mechanism connected with each other by an interlocking means, to ensure that they can be operated in such an interlocked maimer that, halfway in the operation for inclining said back bottom section, said knee bottom section reaches the largest inclination angle, and that, before said back bottom section halfway in the action for inclination reaches the largest inclination, said knee bottom section returns to lie flat.

Furthermore, this invention proposes, a mechanical system for operating the back and knee bottom sections of a bed or the like in an interlocked manner, wherein said back lifting mechanism has a back lifting link that receives a power from a drive source for inclining the back bottom section; said knee lifting mechanism has a knee lifting link that receives power from the drive source through said interlocking means for inclining the knee bottom section; and said knee lifting link is inclined at an angle larger than that of said back lifting link in a state where the entire bottom lies flat.

Further, this invention proposes, a mechanical system for operating the back and knee bottom sections of a bed or the like in an interlocked manner, wherein the bottom of the bed or the like is divided into a back bottom section corresponding to the back of a lying person, a waist bottom section corresponding to his/her waist, a knee bottom section corresponding to the region from his/her waist to knees, and a leg bottom section corresponding to his/her legs; bendable bottom sections respectively bendable at an adequate curvature being installed between said back bottom section and said waist bottom section and between said knee bottom section and said leg bottom section; and said back lifting link is kept in contact with the reverse face of said back bottom section, while said knee lifting link is kept in contact with the reverse face of the bendable bottom section installed between the knee bottom section and the leg bottom section.

Also, this invention proposes a mechanical system for operating the back and knee bottom sections of a bed or the like in an interlocked manner, wherein said interlocking means is composed of a rod adjustable in length, to ensure that the interlocked relation between said back lifting mechanism and said knee lifting mechanism can be adjusted.

Further, this invention proposes a mechanical system for operating the back and knee bottom sections of a bed or the like in an interlocked manner, wherein the inclination angle of said knee lifting link can be adjusted, to ensure that the interlocked relation between said back lifting mechanism and said knee lifting mechanism can be adjusted.

This invention also proposes a mechanical system for operating the back and knee bottom sections of a bed or the like in an interlocked manner, wherein the length of said knee lifting mechanism can be adjusted, to ensure that an angle for achieving the highest knee position can be adjusted.

In a first embodiment of the present invention, while the back lifting mechanism is actuated to incline the back bottom section corresponding to the back of the user, the knee lifting mechanism interlocked with the back lifting mechanism through the interlocking means makes the knee bottom section inclined in the beginning. Subsequently, while said back bottom section is on the way for further inclination, said knee bottom section reaches the largest inclination, and if the back lifting mechanism is further operated to make the back bottom section progressively inclined, the knee lifting mechanism interlocked with it through the interlocking means lowers the knee bottom section for letting it return to a flat position.

In another embodiment, receiving power from a drive source, the back lifting link makes the back bottom section inclined, and receiving a power from the drive source through said interlocking means, the action of the knee lifting link precedes that of the back lifting link. As a result, the tip of the knee lifting link reaches its highest position during back lifting action before the back lifting link reaches its highest position. Also, the knee bottom section reaches the largest inclination angle during the progressive inclination action of the back bottom section.

If the knee lifting link is further operated in interlocked relation with the action of the back lifting link for further back lifting action, the tip of the knee lifting link now begins to decline from said highest position. The knee bottom section gradually falls, and when the back bottom section reaches the largest inclination angle, the knee bottom section returns to a flat position.

In another embodiment, power from the drive source displaces the back lifting link and lifts the back bottom section, making it inclined, and, on the other hand, the power transmitted through the interlocking means displaces the knee lifting link, to let the tip of the knee lifting link move along the bendable bottom section installed between the knee bottom section and the leg bottom section, with the tip kept in contact with the bendable bottom section, for making the knee and leg bottom sections inclined. The action of the knee lifting link precedes that of the back lifting link, and the tip of the knee lifting link reaches its highest position during back lifting action before the tip of the back bottom section reaches its highest position, and the knee bottom section is inclined at the largest angle.

In another embodiment, the length of the interlocking means can be adjusted to change the action start timing of the knee lifting mechanism in relation with the back lifting mechanism. In this case the interlocked relation between the back lifting mechanism and the knee lifting mechanism can be adjusted.

Also, the inclination angle of the knee lifting link can be changed to change the action start timing of the knee lifting mechanism in relation with the back lifting mechanism. In this case, the interlocked relation between the back lifting mechanism and the knee lifting mechanism can be adjusted.

Also, the length of the knee lifting link can be adjusted to adjust the angle for achieving the highest knee position.

DETAILED DESCRIPTION OF THE PREFERRED EMBODIMENTS

The mechanical system for operating the back and knee bottom sections of a bed or the like of this invention is described below as modes for carrying out this invention is described in reference to attached drawings.

Figure 1:
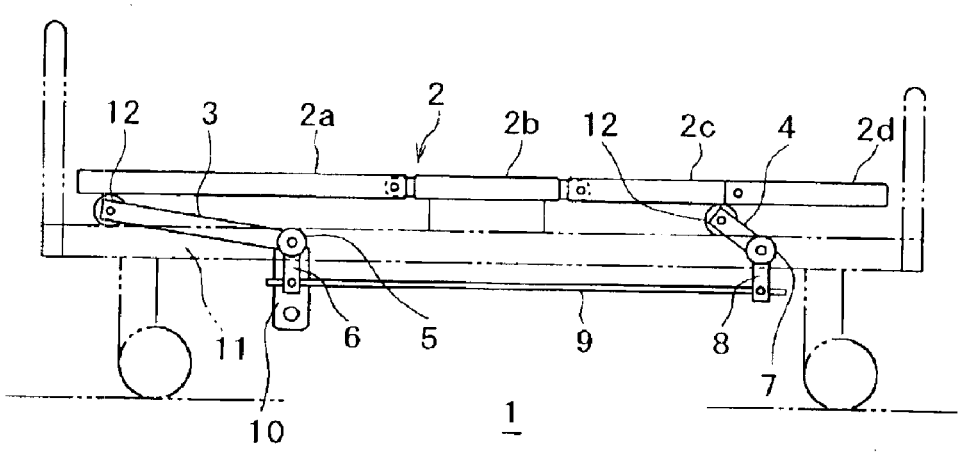
FIG. 1 is a side view showing an embodiment of a bed provided with a mechanical system for operating the back and knee bottom sections in an interlocked manner of the present invention.

In the bed 1 shown in FIG. 1, the bottom 2 is divided into a back bottom section 2*a* corresponding to the back of the user, a waist bottom section 2*b* corresponding to his/her waist, a knee bottom section 2*c* corresponding to the region from his/her waist to knees and a leg bottom section 2*d* corresponding to his/her legs. A back lifting link 3 as a back lifting mechanism is kept in contact with the reverse face of said back bottom section 2*a*, and a knee lifting link 4 as a knee lifting mechanism is kept in contact with the reverse face of either the knee bottom section 2*c* or the leg bottom section 2*d* movably along the reverse faces of both the bottom sections. The back lifting link 3 and the knee lifting link 4 are connected with each other in an interlocked manner by an interlocking means 9 that connects a transmission arm 6 connected with a back lifting shaft 5 of the back lifting link 3, with a receiving arm 8 connected with a knee lifting shaft 7 of the knee lifting link 4.

Furthermore, the back lifting shaft 5 of said back lifting link 3 is connected with a startup arm 10 connected with a well-known drive source for receiving the power from the drive source.

The base end of said back lifting link 3 is immovably connected with the back lifting shaft 5 pivotally rotatably fitted to a main frame 11 of the bed 1, and said back lifting link 3 has a rolling member 12 at its tip end. The rolling member 12 at the tip end is kept in contact with the reverse face of the back bottom section 2*a* movably from the tip end of the back bottom section 2*a* toward the center of the bottom in the longitudinal direction.

The base end of said knee lifting link 4 is immovably connected with the knee lifting shaft 7 pivotally rotatably fitted to the main frame 11 of the bed 1, and the knee lifting link 4 has a rolling member 12 at its tip end. The rolling member 12 at the tip is kept in contact with the reverse face of either the knee bottom section 2*c* or the leg bottom section 2*d* movably along the reverse faces of both the bottom sections.

The transmission arm 6 connected with the back lifting shaft 5 and the receiving arm 8 connected with the knee lifting shaft 7 are equal in size, and the interlocking means 9 connecting the transmission arm 6 and the receiving arm 8 is a rod.

When the bottom 2 of the bed 1 lie flat, the transmission arm 6 and the receiving arm 8 are directed downward in the vertical direction, and the interlocking means 9 is directed in the horizontal direction. Furthermore, the startup arm 10 connected with the back lifting shaft 5 is also directed downward in the vertical direction.

The length of the back lifting link 3 is longer than that of the knee lifting link 4, and when the bottom 2 lies flat, the knee lifting link 4 has a slightly larger inclination angle than that of the back lifting link 3.

The interlocked operation of the mechanical system for operating the back and knee bottom sections of a bed or the like in an interlocked manner referred to above is described below.

If the power from the drive source is used to startup arm 10 connected with the back lifting shaft 5, it is also used by receiving arm 8 connected with the knee lifting shaft 7 which is connected with the knee lifting link 4 provided as the knee lifting mechanism, through the interlocking means 9 from the transmission arm 6 connected with the back lifting shaft 5. In this case, the knee lifting link 4 begins to operate together with the back lifting link 3.

The back lifting link 3 provided as the back lifting mechanism keeps the rolling member 12 at its tip in contact with the reverse face of the back bottom section 2*a*, while the rolling member 12 moves from the tip of the back bottom section 2*a* toward the center of the bottom in the longitudinal direction, to lift the back bottom section 2*a*, for inclining it.

On the other hand, the knee lifting link 4 provided as the knee lifting mechanism keeps the rolling member 12 at its tip in contact with the reverse face of either the knee bottom section 2*c* or the leg bottom section 2*d* movably along the reverse faces of both the bottom sections, to lift the joint between the knee bottom section 2*c* and the leg bottom section 2*d* for inclining both of the bottom sections with the joint as a pivot.

Figure 2:
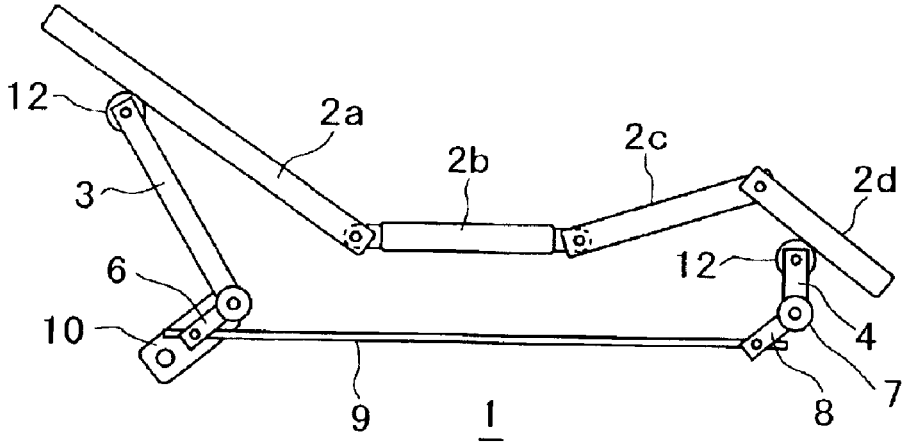
FIG. 2 is a side view of an essential portion for explanation of the interlocked operation of the mechanical system for operating the back and knee bottom sections in an interlocked manner shown in FIG. 1.
Figure 3:
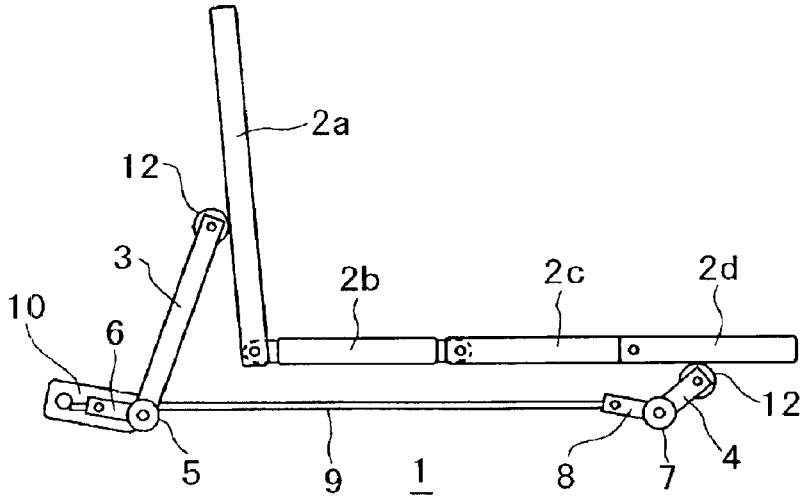
FIG. 3 is a side view of an essential portion of the mechanical system for operating the back and knee bottom sections in an interlocked manner shown in FIG. 1 in a state where its interlocked operation has been completed.

When the bottom 2 of the bed 1 lies flat in the beginning (when the interlocked operation is started), since the inclination angle of the knee lifting link 4 is somewhat larger than that of the back lifting link 3, action of the knee lifting link 4 precedes that of the back lifting link 3. Furthermore, since the length of the back lifting link 3 is longer than that of the knee lifting link 4, the tip of the knee lifting link 4 reaches its highest position during back lifting action before the tip of the back lifting link 3 reaches its highest position, and the knee bottom section 2*c* and the leg bottom section 2*d* are inclined at the largest angles (see FIG. 2 ).

In this case, since the body of the user is supported by the knee bottom section 2*c* preceding in inclination action while back lifting progresses, the slip of the body and the feeling of pressure during back lifting can be reduced.

If the back lifting action is further continued to let the knee lifting link 4 act in interlocked relation with action of the back lifting link 3, the tip of the knee lifting link 4 moves from the highest position toward the reverse face of the leg bottom section 2*d*, while it is kept in contact with the reverse face of the leg bottom section 2*d*. The joint between the knee bottom section 2*c* and the leg bottom section 2*d* gradually declines, causing the knee bottom section 2*c* and the leg bottom section 2*d* to fall, and when the back bottom section 2*a* reaches the largest inclination angle, the knee bottom section 2*c* and the leg bottom section 2*d* return to lie flat, for completing a series of interlocked operation.

In this state, the body of the user is lifted in its upper half and extended in its lower half. In this embodiment, the caregiver can turn the body of the user on the bed without any difficulty, and the user can be moved to a lateral side of the bottom and sit on the bottom with his/her feet placed on the floor.

As described above, in the mechanical system for operating the back and knee bottom sections of a bed or the like of this invention, when the interlocked operation is started, that is, when the bottom 2 lies flat in its original position, the knee lifting link 4 provided as the knee lifting mechanism is kept in contact with the knee bottom section 2*c* at an inclination angle somewhat larger than that of the back lifting link 3 provided as the back lifting mechanism. The knee lifting action can precede the back lifting action, and the pressure to the body of the user can be reduced. Furthermore, the position of the user who has been raised on his/her back using the gatch mechanism can be easily changed to allow him/her to sit with his/her feet placed on the floor. Thus, the convenience of care can be improved.

Figure 4:
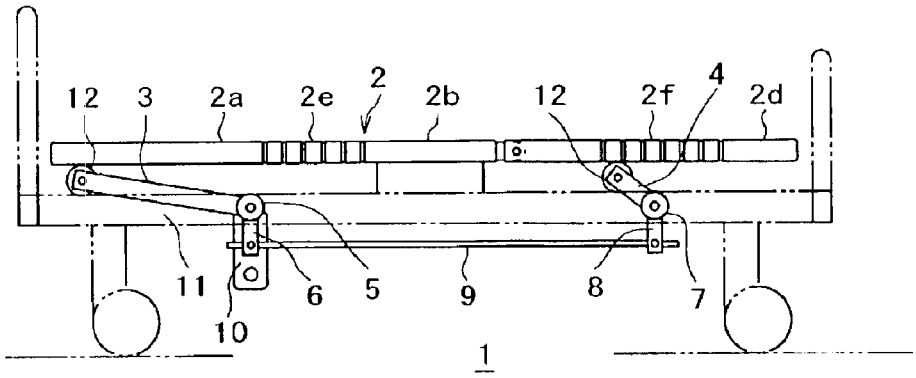
FIG. 4 is a side view showing of another embodiment of a bed provided with the mechanical system for operating the back and knee bottom sections in an interlocked manner of the present invention.

The mechanical system for operating the back and knee bottom sections in an interlocked manner of this invention can also be installed in the following bed. In the bed 1 of this embodiment, as shown in FIG. 4, the bottom 2 is divided into a back bottom section 2*a* corresponding to the back of the user, a waist bottom section 2*b* corresponding to his/her waist, a knee bottom section 2*c* corresponding to the region from his/her waist to knees, and a leg bottom section 2*d* corresponding to his/her legs. Furthermore, bendable bottom sections 2*e* and 2*f* respectively bendable at an adequate curvature are installed between said back bottom section 2*a* and said waist bottom section 2*b* and between said knee bottom section 2*c* and said leg bottom section 2*b*.

Figure 5:
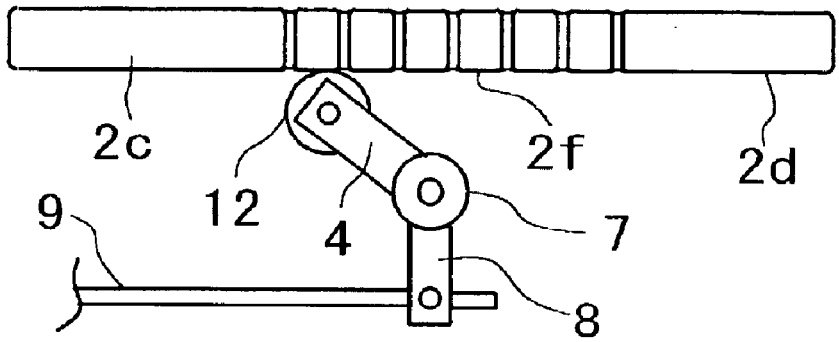
FIG. 5 is an enlarged view of an essential portion of a mechanical system for operating the back and knee bottom sections in an interlocked manner of the bed shown in FIG. 4, particularly showing the relation of the knee lifting mechanism with the knee bottom section and the bendable bottom section in a state where the interlocked operation is started.

A back lifting link 3 as a back lifting mechanism is kept in contact with the reverse face of said back bottom section 2*a*, and a knee lifting link 4 as a knee lifting mechanism is kept in contact with the reverse face of the bendable bottom section 2*f* installed between the knee bottom section 2*c* and the leg bottom section 2*d* (see FIG. 5 ). A well-known drive source is similarly connected with a startup arm 10 connected with a back lifting shaft 5 of the back lifting link 3, and the drive source is started to carry out a series of interlocked operations of the back lifting link 3 and the knee lifting link 4.

In the mechanical system for operating the back and knee bottom sections of above-mentioned bed 1 in an interlocked manner, the power from the drive source is used by startup arm 10 of the back lifting link 3, to displace the back lifting link 3 for lifting and inclining the back bottom section 2*a*. On the other hand, the power can be used by startup arm 10 of the back lifting link 3 to power receiving arm 8 of the knee lifting link 4 provided as the knee lifting mechanism through an interlocking means 9, to displace the knee lifting link 4, so that a rolling member 12*a*t the tip of the knee lifting link 4 is moved along the bendable bottom section 2 f installed between the knee bottom section 2*c* and the leg bottom section 2*d*, while it is kept in contact with the bendable bottom section 2*f*, to incline the knee bottom section 2*c* and the leg bottom section 2*d*.

Figure 6:
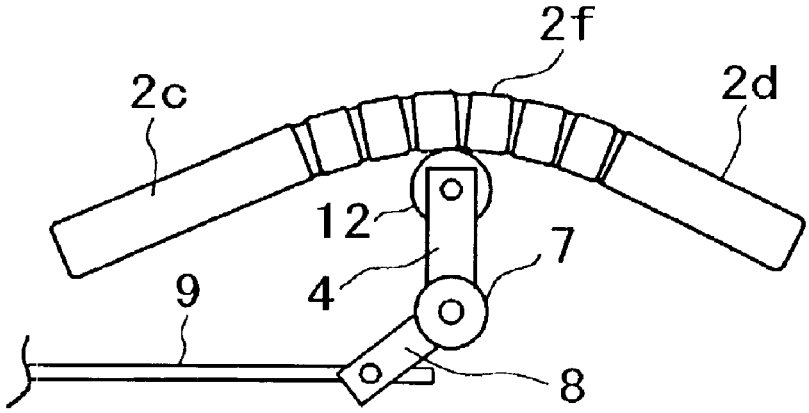
FIG. 6 is an enlarged view of an essential portion of a mechanical system for operating the back and knee bottom sections in an interlocked manner of the bed shown in FIG. 4, particularly showing the relation of the knee lifting mechanism with the knee bottom section and the bendable bottom section in a state where the interlocked operation is on its way.

Also, in this mechanical system for operating the back and knee bottom sections in an interlocked manner, since the inclination angle of the knee lifting link 4 is somewhat larger than that of the back lifting link 3, the knee lifting link 4 precedes the back lifting link 3 in action, and the tip of the knee lifting link 4 reaches its highest position during back lifting action before the tip of the back lifting link 3 reaches its highest position, causing the knee bottom section 2*c* and the leg bottom section 2*d* to be inclined at the largest angles (see FIG. 6 ). Since the body of the user is supported by the knee bottom section 2*c* preceding in inclination action while the back lifting action progresses, the slip of the body and the feeling of pressure due to back lifting action can be reduced.

Figure 7:
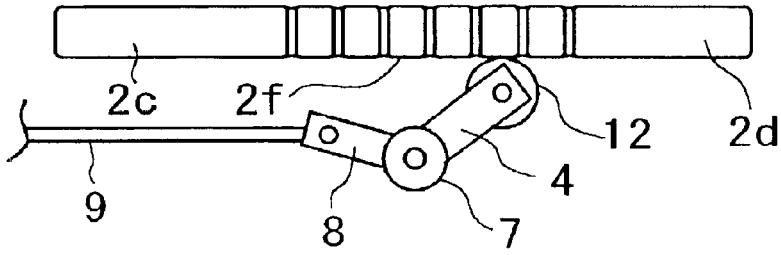
FIG. 7 is an enlarged view of an essential portion of the mechanical system for operating the back and knee bottom sections in an interlocked manner of the bed shown in FIG. 4, particularly showing the relation of the knee lifting mechanism with the knee bottom section and the bendable bottom section in a state where the interlocked operation has been completed.

Furthermore, if the back lifting action is further continued, the tip of the knee lifting link 4 is moved from the highest position along the bendable bottom 2*f* toward the leg bottom section 2*d* while it is kept in contact with the bendable bottom section 2*f*. The knee bottom section 2*c* and the leg bottom section 2*d* gradually fall, and when the back bottom section 2*a* reaches the largest inclination angle, the knee bottom section 2*c* and the leg bottom section 2*d* return to lie flat (see FIG. 7 ).

The mechanical system for operating the back and knee bottom sections in an interlocked manner of this invention can also be constituted as described below.

Figure 8:
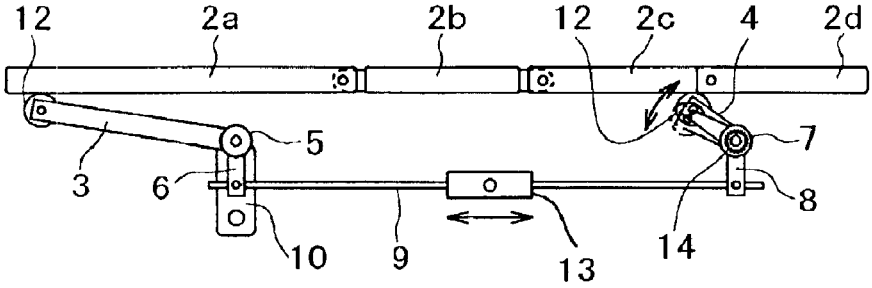
FIG. 8 is a side view of an essential portion showing another embodiment of the mechanical system for operating the back and knee bottom sections in an interlocked manner of this invention.

In the mechanical system for operating the back and knee bottom sections in an interlocked manner shown in FIG. 8, the interlocking means 9 can be a rod adjustable in length, to ensure that the inclination angle of the knee lifting link 4 formed when the back lifting link 3 as the back lifting mechanism and the knee lifting link 4 as the knee lifting mechanism begin to act in an interlocked manner and can be changed to adjust the timing when the inclination of the back bottom section 2*a* starts and the timing when the inclination of the knee bottom section 2*c* and the leg bottom section 2*d* start.

In this case, the interlocking means 9 has a well-known adjusting member 13, e.g. turn buckle etc. at its intermediate position so that the overall length of the interlocking means 9 can be adjusted.

According to the mechanical system for operating the back and knee bottom sections in an interlocked manner as described above, the adjusting member 13 of the interlocking means 9 can be operated to adjust the length for changing the timing when the action of the back lifting link 3 is started and the timing when the action of the knee bottom section 2*c* and the leg bottom section 2*d* is started. Therefore, the interlocked operation of the back lifting mechanism and the knee lifting mechanism can be carried out in any of the following action patterns; (1) the inclination of the back bottom section 2*a* and the inclination of the knee bottom section 2*c* and the leg bottom section 2*d* are started simultaneously, (2) the inclination of the back bottom section 2*a* is started before the inclination of the knee bottom section 2*c* and the leg bottom section 2*d*, and (3) the inclination of the knee bottom section 2*c* and the leg bottom section 2*d* is started before the inclination of the back bottom section 2*a*. Thus, the bed 1 can be adjusted to further suit the diseased condition or demand of the user.

Moreover, in the mechanical system for operating the back and knee bottom sections in an interlocked manner of this invention, the inclination angle of the knee lifting link formed 4 when the action is started can also be made adjustable, to change the timing when the inclination of the back bottom section 2*a* is started and the timing when the inclination of the knee bottom section 2*c* and the leg bottom section 2*d* is started. In this case, the knee lifting link 4 can be connected with the knee lifting shaft 7 pivotally rotatably in a predetermined range, and a clamping means 14 can be used to fix the knee lifting link 4 at a desired inclination angle.

Also with the above-mentioned mechanical system for operating the back and knee bottom sections in an interlocked manner, the interlocked operation of the back lifting mechanism and the knee lifting mechanism can be carried out according to any of various action patterns, and the bed 1 can be adjusted to suit the diseased condition or demand of the user.

Furthermore, in the mechanical system for operating the back and knee bottom sections in an interlocked manner of this invention, if the length of the knee lifting link 4 is made adjustable using any adequate structure, the angle for achieving the highest knee position can be adjusted.

In the above-mentioned mechanical system for operating the back and knee bottom sections in an interlocked manner, if the length of the knee lifting link 4 is made longer, the tip of the knee lifting link 4 can be made correspondingly higher, and the angle for achieving the highest knee position becomes larger. On the other hand, if the length of the knee lifting link 4 is made shorter, the angle for achieving the highest knee position can be made smaller. Thus, the knee lifting action can be made more suitable for the user.

INDUSTRIAL APPLICABILITY

As described above, this invention provides a simple mechanism, in which the action of the knee lifting mechanism precedes that of the back lifting mechanism. Thus, the user does not receive a strong pressure when he/she is squeezed between the back bottom section and the knee bottom section, and since the knee bottom section returns to lie flat when the back bottom section is inclined almost at the largest angle, the user can be moved on the bottom toward a lateral side of the bottom and can sit on the bottom with his/her feet placed on the floor.

That is, the problem of a pressure to the human body due to a gatch mechanism is solved, and it is not necessary to disengage the back and knee bottom sections from the interlocked relation for allowing the user to be easily moved on the bottom and to sit on the bottom at a lateral side of the bottom. Therefore, though the body of the user may slip from the back bottom section or though his/her posture may be disfigured when the back lifting action only is carried out, such an event does not occur in this invention which eliminates the possibility of applying another kind of pressure to the body.

Furthermore, if the length of the interlocking means is made adjustable or if the inclination angle of the knee lifting link as the knee lifting mechanism is made adjustable, the interlocked operation of the back lifting mechanism and the knee lifting mechanism can be carried out according to a desired action pattern, to make the bed suitable for the diseased condition or demand of the user. If the length of the knee lifting link as the knee lifting mechanism is made adjustable, the angle for achieving the highest knee position can be made adjustable to allow adequate knee lifting suitable for the user.

What is claimed is:

1. A mechanical system for operating the back bottom and knee bottom sections of a bed or the like in an interlocked manner by the same power source, comprising a back lifting mechanism and a knee lifting mechanism connected with each other by an interlocking means, to ensure that they can be operated by the same power source in such an interlocked manner that, halfway in the operation for inclining said back bottom section, said knee bottom section reaches the largest inclination angle, and that, before said back bottom section halfway in action for inclination reaches the largest inclination, said knee bottom section returns to lie flat.

2. A mechanical system for operating the back and knee bottom sections of a bed or the like in an interlocked manner, according to claim 1, wherein said back lifting mechanism has a back lifting link that receives power from a drive source for inclining the back bottom section; said knee lifting mechanism has a knee lifting link that receives power from the drive source through said interlocking means for inclining the knee bottom section; and said knee lifting link is inclined at an angle larger than that of said back lifting link in a state where the entire bottom lies flat.

3. A mechanical system for operating the back and knee bottom sections of a bed or the like in an interlocked manner, according to claim 2, wherein the bottom of the bed or the like is divided into a back bottom section corresponding to the back of a lying person, a waist bottom section corresponding to his/her waist, a knee bottom section corresponding to the region from his/her waist to knees, and a leg bottom section corresponding to his/her legs; bendable bottom sections respectively bendable at an adequate curvature are installed between said back bottom section and said waist bottom section and between said knee bottom section and said leg bottom section; and said back lifting link is kept in contact with the reverse face of said back bottom section, while said knee lifting link is kept in contact with the reverse face of the bendable bottom section installed between the knee bottom section and the leg bottom section.

4. The mechanical system for operating the back and knee bottom sections of a bed or the like in an interlocked manner, according to claim 3, wherein the inclination angle of said knee lifting link can be adjusted, to ensure that the interlocked relation between said back lifting mechanism and said knee lifting mechanism can be adjusted.

5. The mechanical system for operating the back and knee bottom sections of a bed or the like in an interlocked manner, according to claim 3, wherein the length of said knee lifting mechanism can be adjusted, to ensure that the angle for achieving the highest knee position can be adjusted.

6. The mechanical system for operating the back and knee bottom sections of a bed or the like in an interlocked manner, according to claim 2, wherein the inclination angle of said knee lifting link can be adjusted, to ensure that the interlocked relation between said back lifting mechanism and said knee lifting mechanism can be adjusted.

7. The mechanical system for operating the back and knee bottom sections of a bed or the like in an interlocked manner, according to claim 6, wherein the length of said knee lifting mechanism can be adjusted, to ensure that the angle for achieving the highest knee position can be adjusted.

8. The mechanical system for operating the back and knee bottom sections of a bed or the like in an interlocked manner, according to claim 2, wherein the length of said knee lifting mechanism can be adjusted, to ensure that the angle for achieving the highest knee position can be adjusted.

9. The mechanical system for operating the back and knee bottom sections of a bed or the like in an interlocked manner, according to claim 2, wherein said interlocking means is composed of a rod adjustable in length, to ensure that the interlocked relation between said back lifting mechanism and said knee lifting mechanism can be adjusted.

10. The mechanical system for operating the back and knee bottom sections of a bed or the like in an interlocked manner, according to claim 1, wherein said interlocking means is composed of a rod adjustable in length, to ensure that the interlocked relation between said back lifting mechanism and said knee lifting mechanism can be adjusted.

* * * * *